United States Patent [19]

Yokoyama et al.

[11] Patent Number: 4,677,050

[45] Date of Patent: Jun. 30, 1987

[54] SILVER HALIDE PHOTOGRAPHIC ELEMENT CONTAINING CROSSLINKED COPOLYMERS

[75] Inventors: Shigeki Yokoyama; Takayuki Inayama; Naohiko Sugimoto; Takashi Naoi, all of Kanagawa, Japan

[73] Assignee: Fuji Photo Film Co., Ltd., Kanagawa, Japan

[21] Appl. No.: 903,888

[22] Filed: Sep. 4, 1986

Related U.S. Application Data

[63] Continuation of Ser. No. 711,917, Apr. 4, 1986, abandoned.

[30] Foreign Application Priority Data

Sep. 3, 1984 [JP] Japan ..... 59-184243
Sep. 3, 1984 [JP] Japan ..... 59-184244

[51] Int. Cl.[4] ..... G03C 1/76

[52] U.S. Cl. ..... 430/536; 430/529; 430/627; 430/631; 430/634

[58] Field of Search ..... 430/523, 529, 536, 627, 430/631, 634, 637

[56] References Cited

U.S. PATENT DOCUMENTS 4,301,240 11/1981 Bruck et al. ..... 430/536
4,363,871 12/1982 Shibue et al. ..... 432/631
4,388,402 6/1983 Mukumoki et al. ..... 430/529

*Primary Examiner*—Jack P. Brammer

*Attorney, Agent, or Firm*—Sughrue, Mion, Zinn, Macpeak and Seas

[57] ABSTRACT

A silver halide photographic material is described, comprising a support having thereon at least one layer containing a cross-linked polymer represented by formula (I)

(I)

wherein $R_1$ and $R_2$ each represents a hydrogen atom or an unsubstituted or substituted alkyl group; $R_3$ represents a hydrogen atom, an unsubstituted or substituted alkyl group, cycloalkyl group, aryl group, or acyl group; $R_4$ represents a hydrogen atom or an unsubstituted or substituted alkyl group; or $R_3$ and $R_4$ together form a ring; L represents a divalent, trivalent or tetravalent connecting group; l represents 0 or 1; m represents an integer of 1 to 3; n represents an integer of 1 to 10; A represents a polymeric unit formed by copolymerizing an ethylenically unsaturated and copolymerizable monomer; B represents a polymeric unit formed by copolymerizing a copolymerizable cross-linking monomer containing at least two copolymerizable and ethylenically unsaturated groups; M represents a cation; w represetns 10 to 95 mol %; x represents 3 to 88 mol %; y represents 0 to 50 mol %, and z represents 2 to 30 mol %.

16 Claims, No Drawings

SILVER HALIDE PHOTOGRAPHIC ELEMENT CONTAINING CROSSLINKED COPOLYMERS

This is a continuation, of application Ser. No. 771,917, filed Apr. 4, 1986, now abandoned.

FIELD OF THE INVENTION

The present invention relates to silver halide photographic materials, and particularly to silver halide photographic materials having improved covering power of a silver halide emulsion and improved antistatic properties.

BACKGROUND OF THE INVENTION

The light-sensitive emulsion layer in a silver halide light-sensitive material comprises a coated silver halide emulsion, which is imagewise exposed and then developed to be reduced to black metallic silver. At this time, in a conventional negative film, more metallic silver is produced to provide a high optical density in an area in which an amount of light for exposure is larger, and less metallic silver is produced to provide a low optical density in an area in which an amount of light for exposure is smaller (a reverse relation exists in the case of a positive film). A smaller amount of silver is necessary to obtain the same optical density when the covering power of a silver halide emulsion is improved. Covering power is defined as a value obtained by dividing the optical density by the amount (g) of developed silver per unit area. This definition is described in T. H. James, *The Theory of the Photographic Process,* 4th Ed., 1977, page 405 (Macmillan Publishing Co., Inc.). It is easily understood from the above definition that the higher is the covering power, the smaller is the amount of silver necessary to obtain the same optical density. Silver is an expensive metal, and therefore the necessary amount of silver can be reduced to lower the cost of production of a silver halide light-sensitive metal by increasing the covering power. Also, there is a possibility of an exhaustion of silver in future, and, therefore, it is very worth in a saving of silver to increase the covering power.

Accordingly, there have been many attempts to increase covering power. One method is to increase the covering power by adding a natural or synthetic hydrophilic polymer to a silver halide emulsion layer. Other known methods of increasing covering power include adding, for example, hydroxyethyl cellulose as described in U.S. Pat. No. 3,003,878, poly-N-vinyl lactam as described in U.S. Pat. No. 3,058,826, polyacrylamide as described in U.S. Pat. No. 3,271,158, laminarin as described in Belgian Pat. No. 611,622, mannan as described in Belgian Pat. No. 611,623, or polyacrylic acid or polymethacrylic acid as described in Japanese Patent Application (OPI) No. 182732/82 (the term "OPI" as used herein refers to an unexamined published patent application).

However, when these natural or synthetic hydrophilic polymers are added to a silver halide emulsion, there were problems, such as that the covering power is improved but not enough, that a so-called "interlayer adhesion" between a silver halide emulsion layer to which the above polymers are added and an adjacent layer thereto lowers, and that the film strength of a silver halide emulsion layer to which the above polymers are added lowers markedly.

For example, when polyacrylamide as described in U.S. Pat. No. 3,271,158 of polyacrylic acid or polymethacrylic acid as described in Japanese Patent Application (OPI) No. 182732/82 is added to a silver halide emulsion layer of a silver halide photographic material, there is a problem that a covering power thereof is improved, but the interlayer adhesion between the emulsion layer and the adjacent layer is lowered. When a silver halide photographic material having the above emulsion layer is developed, there is another problem in that component layers of the silver halide photographic material containing the above emulsion layer are easy to flaw because of remarkable lowering of a film-strength of the above emulsion layer. Accordingly, it was difficult to produce a silver halide light-sensitive material having a high covering power by adding these polymers into an emulsion layer.

Also, as a photographic light-sensitive material generally comprises an insulating support and photographic layer, electrostatic charge is frequently accumulated by contact friction or separation between surfaces of substances of the same or different kinds during the production of photographic light-sensitive materials or at the time of use. This accumulated electrostatic charge causes various problems. The most serious problem is that a light-sensitive emulsion layer may be exposed by discharge of accumulated electrostatic charge before development, whereby a spot or a line (often having a tree branch or a feather-like appearance) occurs on the developed photographic film. This is called "a static mark" and impairs a value of merchandise of a photographic film remarkably. In certain cases, the value of merchandise is quite gone. Static marks induced by accumulated electrostatic charge tend to increase significantly when increasing the speed of a photographic light-sensitive material and the speed of processing a photographic light-sensitive material. Recently, static marks have more easily arisen, because photographic light-sensitive materials have been more subject to high speed and severe treatment, resulting from a high-speed coating, a high-speed photographing, and a high-speed automatic processing.

It is preferred to add an antistatic agent to a photographic light-sensitive material in order to decrease the chances of damage arising from electrostatic charge. However, all antistatic agents generally used in the other field cannot be used in a photographic light-sensitive material, since there is a specific limitation of a photographic light-sensitive material. That is, an antistatic agent capable of being used in a photographic light-sensitive needs to have the properties of (1) not having an adverse influence on any of the photographic properties such as sensitivity, fog, granurality, sharpness, (2) not having an adverse influence on the strength of a layer (that is, not becoming more easily damaged by rubbing or scratching), (3) not having an adverse influence on the antiadhesive characteristics (that is, not becoming more easily adhered to the surface of another photographic light-sensitive material and to the surface of another substance), (4) not accelerating the reduction of the power of the processing solution, and (5) not lowering the strength of adhesion between two component layers in a photographic light-sensitive material. Accordingly, there are a number of limitations when applying an antistatic agent to a photographic light-sensitive material.

One method to avoid damage arising from electrostatic charge is to remove the electrostatic charge in a short time before a static mark-causing discharge occurs, by raising the electric conductivity of a surface of a light-sensitive material.

Accordingly, methods to raise the electric conductivity of a support or a surface coated layer of a photographic light-sensitive material have been investigated. One method was to use an ionic polymer. An attempt to use an anionic polymer having an carboxyl group in order to prevent charging with electricity in a photographic light-sensitive material is disclosed in Japanese Patent Publication Nos. 53587/82, 15375/82, German Patent No. 1,745,061, Japanese Patent Publication Nos. 23827/74, 14415/80, 15267/80, Japanese Patent Application (OPI) No. 89979/73, U.S. Pat. Nos. 2,279,410, 3,791,831 and Japanese Patent Publication No. 28937/72. However, these polymers are hydrophilic, and, when a silver halide photographic light-sensitive material containing these polymers is processed for development, there are problems in that these polymers dissolve out into the (aqueous) developing solution to accumulate therein, whereby the thereafter developed silver halide photographic light-sensitive material is stained and a minute mark of elusion occurs to make a silver halide light-sensitive material cloudy. Moreover, these polymers have a problem in that the power to prevent charging with electricity decreases remarkably, because these polymers diffuse from the layer to which they are added to other layers. An attempt to make a polymer of acrylic acid or methacrylic acid a cross-linked latex in order to solve these problems is described in U.S. Pat. No. 4,301,240. This cross-linked polymer of acrylic acid or methacrylic acid can solve the problem of the above-described non-cross-linked polymer having a carboxyl group. This cross-linked polymer of acrylic acid or methacrylic acid has a power enough to prevent charging with electricity in usual or high humidity conditions, but in low humidity conditions, it has insufficient power to prevent charging, whereby it is substantially impossible to prevent the occurrence of a static mark in a photographic light-sensitive material.

SUMMARY OF THE INVENTION

A first object of the present invention is to provide a silver halide photographic material having a silver halide emulsion having a high covering power.

A second object of the present invention is to provide a silver halide photographic material having an improved adhesion between layers thereof, no defect of separation of layers by development.

A third object of the present invention is to provide a silver halide photographic material having a high film strength of component layers thereof, and which is hard to flaw.

A fourth object of the present invention is to provide a silver halide photographic material in which charging with electricity is effectively prevented.

A fifth object of the present invention is to provide a silver halide photographic material in which charging with electricity particularly in low humidity is effectively prevented.

A sixth object of the present invention is to provide a silver halide photographic material which does not generate scum during development.

A seventh object of the present invention is to provide a silver halide photographic material which does not become cloudy by a development and in which charging with electricity is preventing.

These objects are attained by a silver halide photographic material comprising a support having thereon at least one layer containing a cross-linked polymer represented by formula (I)

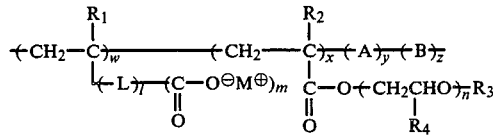

(I)

wherein $R_1$ and $R_2$ each represents a hydrogen atom or an unsubstituted or substituted alkyl group; $R_3$ represents a hydrogen atom, an unsubstituted or substituted alkyl group, cycloalkyl group, aryl group, or acyl group; $R_4$ represents a hydrogen atom or an unsubstituted or substituted alkyl group; or $R_3$ and $R_4$ together form a ring; L represents a divalent, trivalent or tetravalent connecting group; l represents 0 or 1; m represents an integer of 1 to 3; n represents an integer of 1 to 10; A represents a polymeric unit formed by copolymerizing an ethylenically unsaturated and copolymerizable monomer; B represents a polymeric unit formed by copolymerizing a copolymerizable cross-linking monomer containing at least two copolymerizable and ethylenically unsaturated groups; M represents a cation; w represents 10 to 95 mol%; x represents 3 to 88 mol%; y represents 0 to 50 mol%, and z represents 2 to 30 mol%.

DETAILED DESCRIPTION OF THE INVENTION

The cross-linked polymer of the present invention is described below in more detail.

$R_1$ and $R_2$ each represents a hydrogen atom, an unsubstituted alkyl group such as a methyl group, an ethyl group, a n-propyl group and the like, and a substituted alkyl group such as a carboxymethyl group and the like. Among them a hydrogen atom, a methyl group, or a carboxymethyl group is preferred.

$R_3$ represents a hydrogen atom, an unsubstituted alkyl group such as a methyl group, an ethyl group, a n-propyl group, an iso-propyl group, n-butyl group, an iso-butyl group, a n-hexyl group, a n-dodecyl group and the like, a substituted alkyl group such as a benzyl group, a phenethyl group, a 2-chlorohexyl group and the like, an unsubstituted or substituted aryl group such as a phenyl group, a p-methylphenyl group, a p-chlorophenyl group and the like, a cycloalkyl group such as a cyclohexyl group, or an unsubstituted or substituted acyl group such as an acetyl group, a benzoyl group, a p-methoxybenzoyl group and the like. Among them, a lower alkyl group having from 1 to 7 carbon atoms is preferred. $R_4$ represents a hydrogen atom or an unsubstituted or substituted alkyl group such as a methyl group, an ethyl group, a n-propyl group, a chloromethyl group and the like. Among them, a hydrogen atom or a methyl group is preferred.

In the case that $R_3$ and $R_4$ combine together to form a ring, an example of such ring includes a tetrahydrofuran ring.

L represents a divalent, trivalent or tetravalent connecting group. A preferred divalent connecting group is —Q—, a preferred trivalent connecting group is

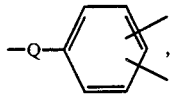

and a preferred tetravalent connecting group is

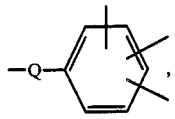

wherein Q represents a divalent connecting group, examples of it including an alkylene group (e.g., a methylene group, an ethylene group, a trimethylene group), an arylene group (e.g., a phenyl group),

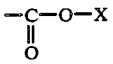

(herein X represents an alkylene group having 1 to about 6 carbon atoms or an arylene group) (e.g.,

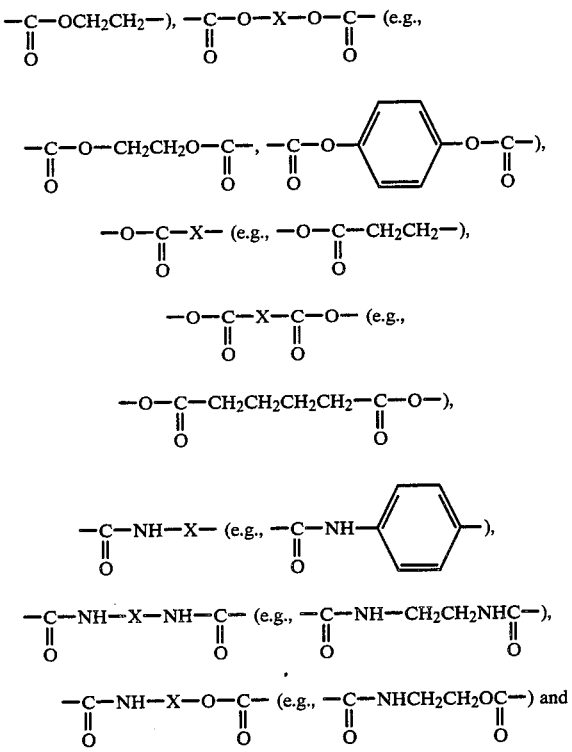

the like. l is 0 or 1. m is an integer of 1 to 3, and an integer of 1 or 2 is preferred. n is an integer of 1 to 10, and an integer of 1 to 5 is preferred.

Examples of monomers useful for providing polymeric unit A include ethylene, propylene, 1-butene, isobutene, styrene, α-methylstyrene, vinyltoluene, ethylene unsaturated ester of fatty acid (e.g., vinyl acetate, allyl acetate), ester of ethylene unsaturated carboxylic acid (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), a monoethylene unsaturated compound (e.g., acrylonitrile) or a diene compound (e.g., butadiene, isoprene) and the like.

Examples of monomers useful for providing polymeric unit B include divinylbenzene, trivinylcyclohexane, ethylene glycol dimethacrylate, diethylene glycol dimethacrylate, triethylene glycol dimethacrylate, ethylene glycol diacrylate, diethylene diacrylate, trimethylolpropane trimethacrylate, pentaerythritol tetramethacrylate and pentaerythritol tetraacrylate.

M includes a polyvalent cation such as a calcium ion, a barium ion, an aluminum ion and the like, besides a monovalent cation such as a hydrogen ion, a sodium ion, a potassium ion, a lithium ion, a cesium ion, an ammonium ion, and the like. Among them a monovalent cation is preferred.

w represents 10 to 95 mol%, preferably 30 to 80 mol%, x represents 3 to 88 mol%, preferably 10 to 60 mol%, y represents 0 to 50 mol%, preferably 0 to 30 mol%, and z represents 2 to 30 mol%, preferably 5 to 20 mol%.

Methods for synthesizing a cross-linked polymer of the present invention are described below, but the present invention is not limited thereto.

First, there is a method wherein a monomer represented by formula (II), a monomer represented by formula (III), a monomer capable of forming polymeric unit A in formula (I), and a monomer capable of forming polymeric unit B in formula (I) are directly emulsion-polymerized in water thereafter be neutralized with alkali, if necessary, in accordance with, for example, the method described in *Research Disclosure,* Vol. 16, RD No. 16102.

Formula (II) is represented by

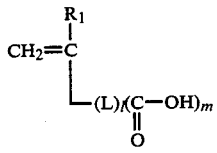

(II)

wherein $R_1$, L, l and m represent groups as described above for formula (I).

Formula (III) is represented by

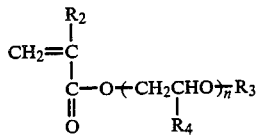

(III)

wherein $R_2$, $R_3$, $R_4$ and n also represent groups as described above for formula (I).

Secondly, there is a method wherein a monomer represented by above formula (III), a monomer capable of forming polymeric unit A in formula (I), and a monomer capable of forming polymeric unit B in formula (I) are emulsion-polymerized in water to form a dispersion of the cross-linked polymer represented by formula (IV), and thereafter the dispersion is saponified with an alkali in the same manner as described, for example, in U.S. Pat. No. 4,301,240.

Formula (IV) is represented by

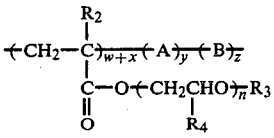

(IV)

wherein $R_2$, $R_3$, $R_4$, n, A, B, w, x, y and z represent groups as described above for formula (I).

Thirdly, there is a method wherein a monomer represented by formula (II), a monomer represented by formula (III), a monomer capable of forming polymeric unit A in formula (I), and a monomer capable of forming polymeric unit B are emulsion-copolymerized in a reverse phase in the same way as the method described, for example, in U.S. Pat. No. 4,301,240; thereafter the generated cross-linked polymer is again dispersed in water, and neutralized with an alkali, if necessary. The most preferred method is selected from these methods depending on species of each monomer and the copolymeric ratio.

Examples of cross-linked copolymers of the present invention are described below.

Polymer 1

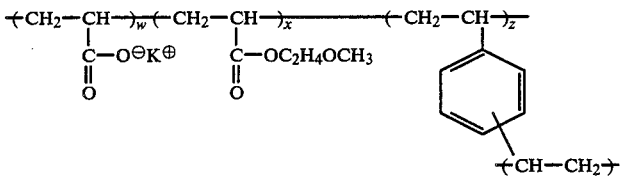

w/x/z = 58/22/20 (mol %)

Polymer 2

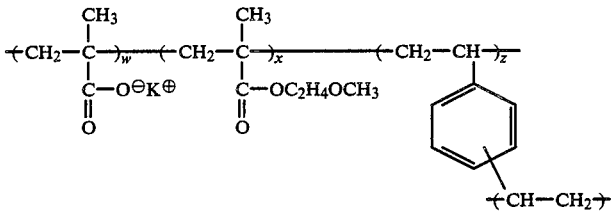

w/x/z = 50/40/10 (mol %)

Polymer 3

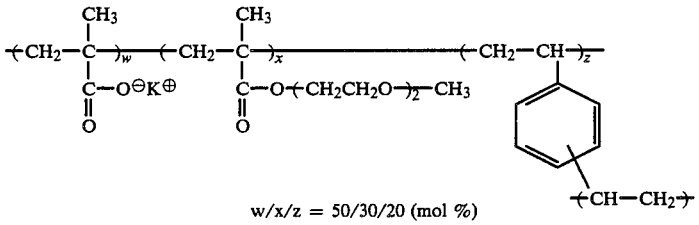

w/x/z = 50/30/20 (mol %)

Polymer 4

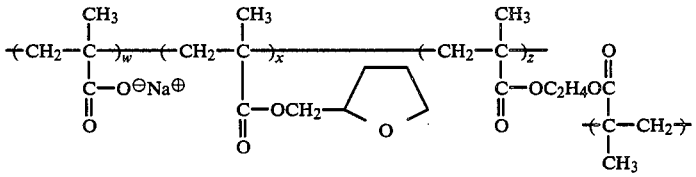

w/x/z = 40/45/15 (mol %)

Polymer 5

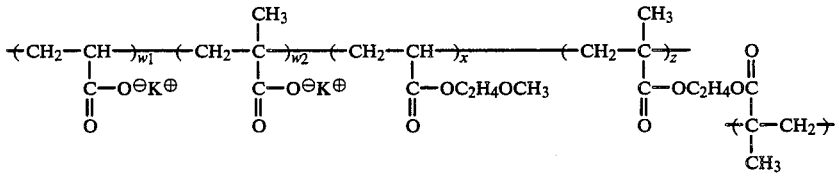

$w_1/w_2/x/z$ = 48/12/30/10 (mol %)

Polymer 6

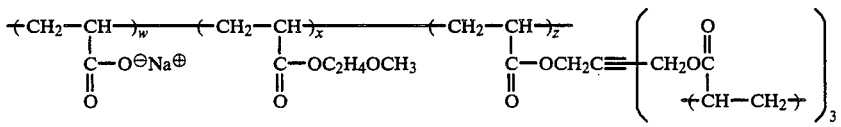

w/x/z = 75/15/10 (mol %)

-continued
Polymer 7
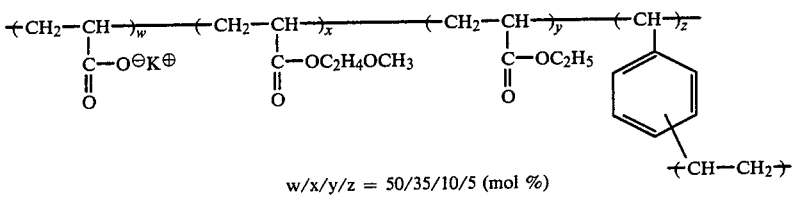
w/x/y/z = 50/35/10/5 (mol %)
Polymer 8
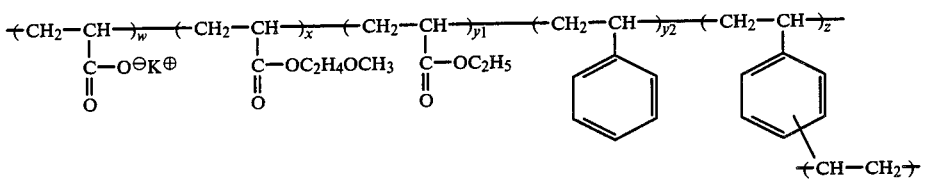
$w/x/y_1/y_2/z$ = 30/40/10/10/10 (mol %)
Polymer 9
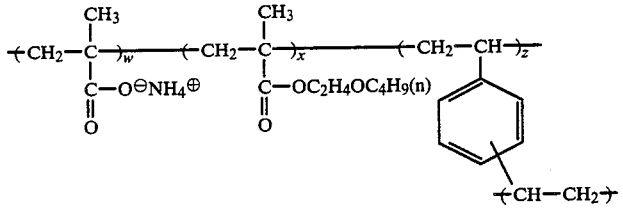
w/x/z = 75/15/10 (mol %)
Polymer 10
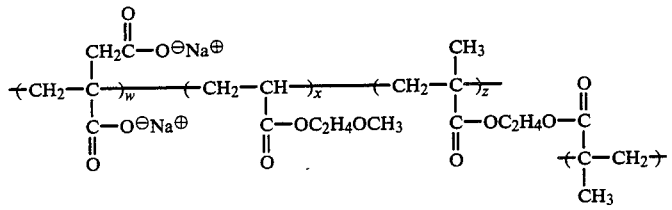
w/x/z = 60/20/20 (mol %)
Polymer 11
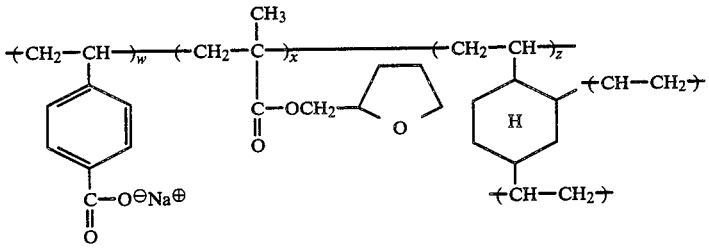
w/x/z = 40/45/15 (mol %)
Polymer 12
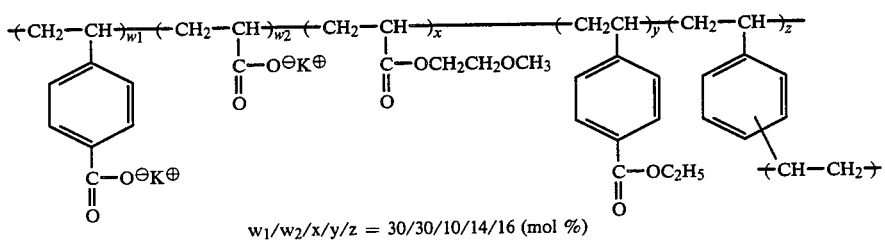
$w_1/w_2/x/y/z$ = 30/30/10/14/16 (mol %)

-continued

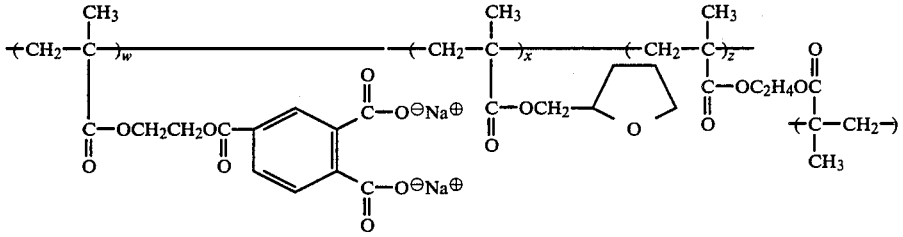

Polymer 13 w/x/z = 50/40/10 (mol %)

Examples of synthesizing cross-linked copolymers of the present invention are described below.

SYNTHESIS EXAMPLE 1

Synthesis of cross-linked polymer 1

480 ml of distilled water, 1.95 g of the emulsifying agent (which was sold under the trade name of SANDETTO BL by Sanyo Kasei Inc.) and a mixed solution of 104.1 g of methoxyethyl acrylate and 26.0 g of divinylbenzene were added to a 2 l-three necked distillation flask having a stirrer, a reflux condenser, and a thermometer, and the mixture was stirred under nitrogen gas at 250 rpm while heating at 90° C. After air was sufficiently substituted with nitrogen gas in the flask, a solution dissolving 0.54 g of potassium persulfate in 30 ml of distilled water was added into the flask to initiate polymerization while emulsifying. The mixture was stirred at 90° C. for an hour and a half to obtain a cloudy cross-linked polymer dispersion (latex).

Moreover, a solution dissolving 0.054 g of potassium persulfate in 10 l ml of distilled water was added and the mixture was stirred for half an hour while heating, thereafter being cooled to room temperature. A small amount of a cohering material was filtered off to obtain 629.5 g of a cross-linked polymer dispersion (latex) containing 19.7 wt% solid material. The cross-linked polymer had an average particle size of 0.154 μm, when measured by a dynamic light scattering method (*Powder Technology*, 24 (1979), pp. 91–96).

The above cross-linked polymer (latex) was added to another 3-three necked distillation flask having a stirrer, a reflux condenser and a thermometer, and then a solution of 4.19 g of potassium hydroxide in 183 ml of distilled water was added dropwise to the mixture over a period of one hour. After the mixture was stirred for two hours at room temperature, it was moreover stirred for 2.5 hours at 98° to 99° C. Thereafter, a solution of 7.42 g of potassium hydroxide dissolved in 183 ml of distilled water was added to the mixture for 30 minutes and the mixture was stirred for 3.5 hours at 98° to 99° C. After a solution containing 25.6 g of potassium hydroxide dissolved in 632 ml of distilled water was added into the mixture over 30 minutes, the mixture was further stirred for 12 hours at 98° to 99° C. The mixture was cooled, refined by dialysis and condensed to obtain 1,237 g of a dispersion of Cross-linked Polymer 1. It has a density of solid matter of 8.77 wt%, a saponification ratio of 72.5% measured by acid-base titration, and a cross-linked polymer particle diameter of 0.431 μm measured by a dynamic light scattering method.

SYNTHESIS EXAMPLE 2

Synthesis of Cross-linked polymer 6

1 l of distilled water and 4.45 g of an emulsifying agent (the same emulsifying agent as used in Synthesis Example 1) were added to a 3 l-three necked distillation flask having a stirrer, a reflux condenser, a thermometer, and a pump dropping a uniform volume, and the mixture was stirred under nitrogen gas at 94° to 95° C. at 250 rpm. After air was sufficiently substituted with nitrogen gas in the flask, (1) a mixture solution of 90.0 g of acrylic acid, 32.5 g of methoxyethyl acrylate, and 58.6 g pentaerythritol tetraacrylate, (2) a solution of 2.8 g of potassium persulfate dissolved in 140 ml of distilled water, and (3) a solution of 1.4 g of hydrogen sodium sulfite and 0.56 g of ferrous chloride dissolved in 140 ml of distilled water were simultaneously added to the mixture over a period of 1.5 hours. After completion of the dropping, the mixture was stirred for 15 minutes, and then a solution containing 2.8 g of potassium persulfate and 2.8 g of hydrogen sodium sulfite dissolved in 140 ml of distilled water was added to the mixture and the mixture was further stirred while heating for an hour and 15 minutes. Then a solution of 40.0 g of sodium hydroxide in 200 ml of distilled water was slowly added to the mixture to neutralized, thereafter to cool to room temperature. A small amount of a cohering material was filtered to obtain 1,751 g of the dispersion of Cross-linked Polymer 6 having a solid matter content of 11.0 wt% and an average particle size of 0.229 μm, measured by a dynamic light scattering method.

The cross-linked polymer of the present invention represented by the formula (I) is added to a silver halide emulsion in order to improve a covering power; the amount varies depending on the kind of silver halide emulsion. Generally, a preferred amount thereof is from 10 to 200 wt% based on a binder (usually gelatin) in a silver halide emulsion and a more preferred amount is from 30 to 150 wt%. The amount of coated cross-linked polymer preferably is from 0.1 to 15 g/m$^2$, and particularly preferably from 0.3 to 10 g/m$^2$.

When the cross-linked polymer represented by formula (I) is used as an antistatic agent, it is preferably added in the outermost layer (for example, a surface protective layer, a back layer). In this case an amount of the polymer used is from 0.1 to 15 g/m$^2$, and particularly preferably from 0.3 to 10 g/m$^2$.

The cross-linked polymer represented by formula (I) is added to a layer of a photographic light-sensitive material by a method wherein the above polymer is dispersed in water, an organic solvent (for example, methanol, ethanol, acetaone, methyl ethyl ketone, ethyl acetate, acetonitrile, dioxane, dimethylformamide, formamide, dimethyl sulfoxide, methyl cellosolve, ethyl cellosolve and the like, particularly preferably, methanol, ethanol) or a mixture thereof and the dispersion is added to a coating solution for a silver halide emulsion layer or a surface protective layer to be coated; the dispersion is immediately sprayed or coated; or a photographic light-sensitive material is soaked in the dispersion and dried.

Support bases to be used in the photographic light-sensitive materials of this invention include films made of polyolefins (e.g., polyethylene), polystyrene, cellulose derivatives (e.g., cellulose triacetate), cellulose esters (e.g., polyethylene terephthalate), etc., baryta paper; synthetic paper or paper laminated with these polymer films on both sides thereof; and the like.

The support base to be used in the present invention may be provided with an antihalation layer. For this purpose, carbon black or various dyes such as oxonole dyes, azo dyes, arylidene dyes, styryl dyes, anthraquinone dyes, merocyanine dyes and tri- or di-allylmethane dyes can be used.

Binders used for such an antihalation coating include cellulose mono- or di-acetate, polyvinyl alcohol, polyvinyl butyral, polyvinyl acetal, polyvinyl formal, polymethacrylic esters, polyacrylic esters, polystyrene, a styrene/maleic anhydride copolymer, polyvinyl acetate, a vinyl acetate/maleic anhydride copolymer, a methyl vinyl ester/maleic anhydride copolymer, polyvinylidene chloride and derivatives of these polymers.

The light-sensitive materials in accordance with the present invention can include ordinary black-and-white silver halide photographic light-sensitive materials (e.g., black-and-white light-sensitive materials for black-and-white photography, X-ray imaging, printing, etc.), ordinary multilayer color photographic light-sensitive materials (e.g., color reversal films, color negative films, color positive films, etc.), and various other light-sensitive materials. In particular, silver halide light-sensitive materials intended for high temperature rapid processing and high sensitivity silver halide light-sensitive materials can be provided with a remarkable antistatic effect by the present invention.

Other components able to be used in the photographic light-sensitive material of the present invention, for example, a kind and a preparation of a silver halide emulsion, a chemical sensitizer, a spectral sensitizer, an antifoggant, a stabilizer, a color coupler, a binder such as gelatin, a hardener, a polymer latex except a dispersion of the cross-linked polymer of the present invention, a coating aid agent, a slipping agent, another antistatic agent, a method of exposure and development of the photographic light-sensitive material, and so on are not limited, and, with respect to these matters, reference can be made to the description in Research Disclosure, Vol. 176, pages 22 to 31 (December, 1978).

For example, acid-processed gelatin is preferably used as gelatin.

As a hardener, an active vinyl compound having a vinylsulfonyl group and so on, or an active halogen compound such as 2,4-dichloro-6-hydroxy-s-triazine is preferably used.

A silver halide emulsion is usually prepared by mixing a solution containing a hydrophilic silver salt (for example, silver nitrate) and a solution containing a hydrophilic halogen salt in the presence of a solution containing a hydrophilic high molecular compound. As this silver halide, silver chloride, silver bromide, mixed silver halogenide such as silver chlorobromide, silver iodobromide, silver chloroiodobromide and so on can be used.

The average grain size of the silver bromide grains is preferably below 2 μm, more preferably below 0.4 μm (in the case of a silver halide grain of a spherical form or a form similar to spherical, the diameter of the grain is used as the grain size and in the case of a silver halide grain of a cubic form, the length of the size is used as the grain size. The average grain size is determined based on the projected areas). The distribution of grain size may be narrow or broad.

These silver halide particles may have a cubic form, an octahedral form and a composite form of these crystal forms. Also, different silver halide photographic emulsion independently formed may be mixed.

Moreover, the crystal structure of silver halide grains may be a homogeneous structure or a layer-structure different between the inside thereof and the outside thereof, and may belong to a conversion type such as described in British Pat. No. 635,841 and U.S. Pat. No. 3,622,318. Also, the silver halide grain may be a grain mainly forming a latent image on the surface thereof or a grain mainly forming a latent image in the interior thereof.

Formation of silver halide grains or physical aging may be caried out in the presence of cadmium salts, zinc salts, thallium salts, iridium salts or complex salts thereof, rhodium salts or complex salts thereof, or iron salts or complex salts thereof, etc.

The silver halide emulsions of the present invention are preferably chemically sensitized.

Namely, it is possible to use a sulfur sensitization process using sulfur containing compounds capable of reacting with active gelatin or silver (for example, thiosulfates, thioureas, mercapto compounds or rhodanines), a reduction sensitization process using reducing substance (for example, stannous salts, amines, hydrazine derivatives, formamidinesulfinic acid, or silane compounds) and a noble metal sensitization process using noble metal compounds (for example, gold complex salts and complex salts of metals of Group VIII in the Periodic Table, such as Pt, Ir or Pd, etc.), etc., which may be used alone or as a combination thereof.

Photographic emulsions as used in the present invention may include various compounds for the purpose of preventing fog formation or of stabilizing photographic performance in light-sensitive material during the production, storage or photographic processing thereof. For example, antifoggants or stabilizers can be incorporated, including azoles (for example, benzothiazolium salts, nitroimidazoles, nitrobenzimidazoles, chlorobenzimidazoles, bromobenzimidazoles, nitroindazoles, benzotriazoles, aminotriazoles, and the like), mercapto compounds (for example, mercapthothiazoles, mercaptobenzothiazoles, mercaptobenzimidazoles, mercaptothiadiazoles, mercaptotetrazoles (particularly, 1-phenyl-5-mercaptotetrazoles, mercaptopyrimidines, mercaptotriazines and the like), thioketo compounds, such as oxazolinethione, etc., azaindenes (for example, triazaindenes, tetraazaindenes (particularly 4-hydroxy-substituted (1,3,3a,7)tetraazaindenes), pentaazaindenes, and the like), benzenethiosulfonic acids, benzenethiosulfinic acids, benzenesulfonic amides, and the like.

Photographic emulsion layers or other hydrophilic colloid layers of the light-sensitive material of the present invention can contain various surface active agents as coating aids or for other various purposes, e.g., prevention of charging, improvement of slipping properties, acceleration of emulsification and dispersion, prevention of adhesion, and improvement of photographic characteristics (particularly development acceleration, high constrast, and sensitization).

Surface active agents which can be used include nonionic surface active agents, e.g., saponin (steroid-based), alkylene oxide derivatives (e.g., polyethylene glycol, a polyethylene glycol/polypropylene glycol condensate polyethylene glycol alkyl esters or polyethylene glycol alkylaryl etsters, polyethylene glycol esters, polyethylene glycol sorbitan esters, polyalkylene glycol alkylamines, or polyalkylene glycol alkylamides, and silicone/polyethylene oxide adducts, etc.), glycidol derivatives (e.g., alkenylsuccinic acid polyglyceride and alkylphenol polyglyceride, etc.), fatty acid esters of polyhydric alcohols, and alkyl esters of sugar, etc.; anionic surface active agents containing acidic groups, such as a carboxy group, a sulfo group, a phospho group, a sulfuric acid ester group, and a phosphoric acid ester group, for example, alkylcarboxylic acid salts, alkylsulfonic acid salts, alkylbenzensulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl esters, and polyoxyethylene alkylphosphoric acid esters, amphoteric surface active agents, such as amino acids, aminoalkylsulfonic acids, aminoalkylsulfuric acid or aminoalkylphosphoric acid esters, alkylbetaines, and amino oxides; and cationic surface active agents, e.g., alkylamino salts, aliphatic or aromatic quaternary ammonium salts, heterocyclic quaternary ammonium salts (e.g., pyridinium and imidazolium), and aliphatic or heterocyclic phosphonium or sulfonium salts.

It is preferred because of preventing from charging with electricity and improving slipperiness to use a fluorine-containing surface active agent.

Specific examples of a fluorine-containing surface active agent include the below.

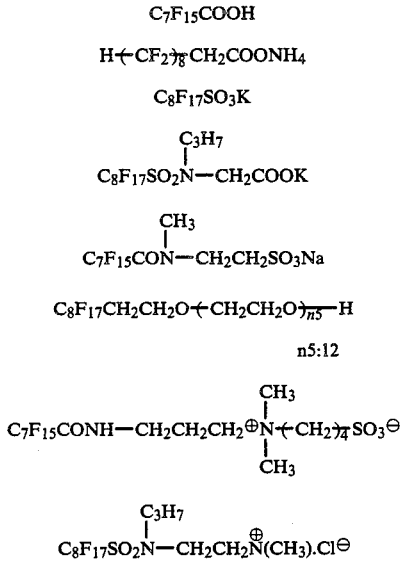

The photographic emulsion used in the prevent invention can also be spectrally sensitized with methine dyes or other dyes, such as cyan dyes, merocyanine dyes, complex cyanine dyes, complex merocyanine dyes, holopolar cyanine dyes, hemicyanine dyes, styryl dyes, hemioxonol dyes. Of these dyes, cyanine dyes, merocyanine dyes and complex merocyanine dyes are particularly useful. Any conventional nuclei for cyanine dyes may be used in these dyes as basic heterocyclic nuclei, including, e.g., a pyrroline nucleus, an oxazoline nucleus, a thiazoline nucleus, a selenazole nucleus, an imidazole nucleus, a tetrazole nucleus, a pyridine nucleus, etc., in addition to nuclei formed by condensing alicyclic hydrocarbon rings with these nuclei and nuclei formed by condensing aromatic hydrocarbon rings with these nuclei, e.g., an indolenine nucleus, a benzindolenine nucleus, an indole nucleus, a benzoxazole nucleus, a naphthothiazole nucleus, a benzoselenazole nucleus, a benzimidazole nucleus and a quinoline nucleus. The carbon atoms of these nuclei can also be substituted.

The merocyanine dyes and the complex merocyanine dyes that can be employed contain 5- or 6-membered heterocyclic nuclei such as a pyrazoline-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, and the like.

The photographic emulsion layer of the photographic light-sensitive material of the present invention may contain compounds such as polyalkylene oxide or its ether, ester, amines, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

EXAMPLE 1

(1)

Preparation of Sample

A silver halide emulsion having the following components was coated on a subbing processed polyethylene terephthalate film having a thickess of 180 μm at an amount of coated silver of 2.5 g/m$^2$. Thereabove, a protective layer having the below-mentioned components was coated. Then it was dried to prepare a black-and-white silver halide light-sensitive material.

Silver halide emulsion:

0.6 mg per mol of silver halide of chloroauric acid and 3.4 mg per mole of silver halide of sodium thiosulfate were added into an emulsion containing a silver iodobromide containing 1.5 mol% of silver iodide and gelatin (an average silver halide particle size is 1.3 μm) and the emulsion was ripened for 50 minutes while heating at 60° C. 4-hydroxy-6-methyl-1,3,3a,7-tetraazaindene was added into the obtained emulsion as a stabilizer.

Protective layer:

Thickness: about 1 μm

Components and coating amount

- Gelatin: 1.5 g/m$^2$
- Sodium salt of 2,6-dichloro-4-hydroxy-1,3,5-triazine: 2 mmol/100 g in total amount of coated gelatin in a protective layer and an emulsion layer
- Sodium dodecysulfate: 10 mg/m$^2$.

The sample obtained in such a way as above was called to Sample No. 1 (blank).

40 wt% of gelatin in the above-mentioned emulsion layer was substituted to the polymer of the present invention or a polymer for comparison, thereby Sample No. 2 to Sample No. 9 being prepared.

(2)

Methods of Testing

Test of a covering power:

Samples were imagewise exposed by use of a sensitometer, processed for 90 seconds by use of Fuji X-ray Automatic Processor RN and dried. In this process, samples were developed by the developing solution having the following components at 35° C.

| Composition of Developing Solution | |
|---|---|
| Potassium hydroxide | 29 g |
| Glacial acetic acid | 11 g |
| Potassium sulfite | 44 g |
| Sodium bicarbonate | 7.5 g |
| Boric acid | 1 g |
| Diethylene glycol | 29 g |
| Ethylene diamine tetraacetic acid | 1.7 g |
| 5-Methylbenzotriazole | 0.06 g |
| 5-Nitroindazole | 0.25 g |
| Hydroquinone | 30 g |
| 1-Phenyl-3-pyrazolidone | 1.5 g |
| Sodium metabisulfite | 12.6 g |
| Glutaraldehyde | 5 g |
| Potassium bromide | 6 g |
| Water to make | 1.0 l |
| | (pH 10.25) |

An optical density and an amount (g/m$^2$) of developed silver of the thus processed sample were measured, thereafter a covering power being calculated.

Test of adhesion between the component layers:

In each process of developing, fixing and washing, a cross-shaped scratch was brought to a face of a side of a photographic emulsion of a sample in the processing solution by use of a steel pen, thereafter the area of the scratch being rubbed in the direction perpendicular to one line of the cross-shaped scratch by a fingertip. The sample in which component layer was not peeled off outside the area of the scratch was ranked Class A. The sample in which a value of a maximum width of a peeled layer was below 5 mm was ranked Class B. The sample in which a value of a maximum width thereof was more than 5 mm was ranked Class C.

Scratching Test

After a sample was soaked in a developing solution, the sample was scratched on the swelling layer by use of a steel needle having a globular point of 0.1 R, while the weight bearing on the needle was continuously changed. The minimum weight necessary to take a scratch on the surface of the layer was measured.

(3)

Results of Test

Results of the test are set forth in Table 1.

TABLE 1

| Sample No. | Polymer Added | Covering Power | Adhesion | Scratching Test |
|---|---|---|---|---|
| 1 | Blank | 0.50 | Class A | 120 g |
| 2 | Polymer 1 (the present invention) | 0.72 | Class A | 53 g |
| 3 | Polymer 3 | 0.71 | " | 49 g |
| 4 | 4 | 0.70 | " | 50 g |
| 5 | 6 | 0.72 | " | 45 g |
| 6 | 10 | 0.68 | " | 55 g |
| 7 | 11 | 0.68 | " | 47 g |
| | Comparative Polymer | | | |
| 8 | A | 0.71 | Class C | 20 g |
| 9 | B | 0.68 | " | 18 g |

Comparative polymer A = polyacrylamide molecular weight = 60,000 (described in U.S. Pat. No. 3,271,158)

Comparative polymer B = sodium polyacrylate molecular weight = 5,000 (Polymer (2) described in Japanese Patent Application (OPI) No. 182732/82)

It is apparent from Table 1 that the silver halide photographic material containing Comparative Polymer A or B in the silver halide emulsion layer has an improved covering power, but it is remarkably lowered in adhesion between the component layers, and is very easily scratched. On the other hand, the silver halide photographic materials containing the polymer of the present invention have an improved covering power, do not lower adhesion between the component layers, and are much more difficult to scratch than the light-sensitive material containing the comparative polymer, although they are easier to scratch than the sample containing no polymer (blank).

EXAMPLE 2

(1)

Preparation of the sample

A silver halide emulsion having the following components was coated on a subbing processed polyethylene terephthalate film having a thickness of 180 μm. Thereabove, a protective layer having the following components was coated. Then it was dried to prepare a black-and-white silver halide light-sensitive material.

Emulsion layer:

Thickness: about 5 μm

Component and Coating amount

Lime-processed gelatin: 2.5 g/m$^2$

Silver iodobromide (silver iodide 1.5 mole%): 5 g/m$^2$

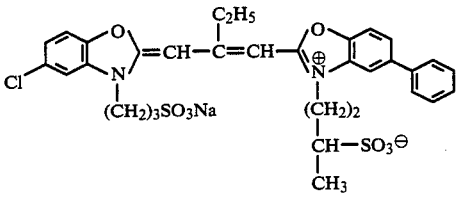

6 g/m$^2$

1-Phenyl-5-mercaptotetrazole: 25 mg/m$^2$.

Protective layer:

Thickness: about 1 μm

Component and Coating amount

Lime-processed gelatin: 1.7 g/m$^2$

Sodium salts of 2,6-dichloro-4-hydroxy-1,3,5-triazole: 10 mg/m$^2$

Sodium N-oleyl-N-methyltauric acid: 7 mg/m$^2$.

Sample No. 11 comprised only the above-mentioned components and Sample No. 12 through Sample No. 18 contained the polymer of the present invention or a comparative polymer at an amount of 1.7 g/m$^2$ in the protective layer in addition to the components of Sample No. 11. Further, Sample No. 19 through Sample No. 25 were prepared by substituting gelatin in the protective layer at half the amount (corresponding to 0.85 g/m$^2$) with respect to the polymer of the present invention or the comparative polymer.

(2)

Method of determination of antistatic ability

Antistatic ability was determined by measuring the surface resistance coefficient and an arising static mark. First, a surface resistance coefficient was determined by measuring an one minute-value by use of an insulation tester (type TR8651) produced by Takeda Riken, putting the sample between two brazen electrodes (the part contacting with a sample is made of stainless steel) having a length of 10 cm and being at intervals of 0.14 cm. Second, testing of a static mark was carried out by a method wherein the non-exposed light-sensitive material was contacted on the side of the surface of the layer containing an antistatic agent to a rubber seat while being pressed by a rubber roller, thereafter being peeled apart.

The surface resistance coefficiency was measured at 25° C. and 25% RH, and at 25° C. and 10% RH, and a test of arising of a static mark was carried out at 25° C., 25% RH and 25° C., 10% RH. The sample was left of twenty-four hours in the above condition, in order that the condition in the layer in the sample coincides with the above condition.

The above samples were developed by use of a developing solution containing the components set forth below at 20° C. for 5 minutes to determine the degree of occurrence of static marks.

| Components of Developing Solution | |
|---|---|
| Salt of N—methyl-p-aminophenol sulfate | 4 g |
| Salt of sulfite anhydride | 60 g |
| Hydroquinone | 10 g |
| Sodium carbonate monohydrate | 53 g |
| Potassium bromide | 25 g |
| Water to make | 1 l |

The occurrence of static marks was determined according to the below five ranks.

A: No static marks were found.

B: Static marks occurred to a small extent.

C: Static marks occurred to a considerable extent.

D: Static marks occurred markedly.

E: Static marks occurred throughout the surface.

The results are shown in Table 2.

TABLE 2

| Sample No. | Antistatic Agent | Coating Amount (g/m) | Antistatic Ability 25° C., 25% RH Surface Resistance | Static mark | 25° C., 10% RH Surface Resistance | Static mark |
|---|---|---|---|---|---|---|
| 11 | | | $1.1 \times 10^{14}$ | E | $7.2 \times 10^{15}$ | E |
| 12 | Polymer 1 (present invention) | 1.7 | $1.0 \times 10^{11}$ | A | $8.3 \times 10^{11}$ | A |
| 13 | Polymer 3 | " | $2.1 \times 10^{11}$ | A | $7.9 \times 10^{11}$ | A |
| 14 | Polymer 5 | " | $3.3 \times 10^{11}$ | A | $1.5 \times 10^{12}$ | A |
| 15 | Polymer 6 | " | $8.6 \times 10^{10}$ | A | $7.0 \times 10^{11}$ | A |
| 16 | Polymer 10 | " | $6.9 \times 10^{10}$ | A | $7.1 \times 10^{11}$ | A |
| 17 | Polymer 13 | " | $2.5 \times 10^{11}$ | A | $9.5 \times 10^{11}$ | A |
| 18 | Comparative Polymer A | " | $4.1 \times 10^{11}$ | A | $3.6 \times 10^{13}$ | D |
| 19 | Polymer 1 (present invention) | 0.85 | $3.2 \times 10^{11}$ | A | $2.1 \times 10^{12}$ | A |
| 20 | Polymer 3 | " | $6.0 \times 10^{11}$ | A | $2.7 \times 10^{12}$ | A |
| 21 | Polymer 5 | " | $1.1 \times 10^{12}$ | A | $4.0 \times 10^{12}$ | B |
| 22 | Polymer 6 | " | $2.5 \times 10^{11}$ | A | $2.1 \times 10^{12}$ | A |
| 23 | Polymer 10 | " | $2.0 \times 10^{11}$ | A | $2.0 \times 10^{12}$ | A |
| 24 | Polymer 13 | " | $8.0 \times 10^{11}$ | A | $3.1 \times 10^{12}$ | B |
| 25 | Comparative Polymer A | " | $1.3 \times 10^{12}$ | A | $1.2 \times 10^{14}$ | E |

Comparative polymer A

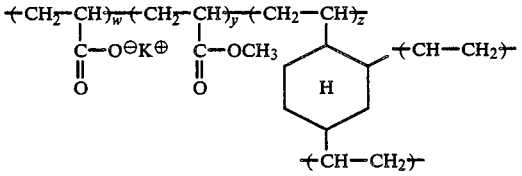

w/y/z = 76/16/8 (mol %)

(This polymer was synthesized according to Method 8.2 in Example 8 described in U.S. Pat. No. 4,301,240.)

It is apparent in Table 2 that a black-and-white silver halide photographic light-sensitive material containing Comparative Polymer A in the protective layer is sufficiently prevented from charging with electricity at 25° C. and 25% RH, but it is not sufficiently prevented from charging with electricity at 25° C. and a low humidity of 10% RH and a static mark remarkably arises in it.

On the other hand, it is apparent in Table 2 that a black-and-white silver halide photographic light-sensitive material containing the polymer of the present invention in the protective layer is sufficiently prevented from charging with electricity not only at 25° C. and 25% RH, but also at 25° C. and a low humidity of 10% RH, and that static marks scarcely occur in it.

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon a silver halide emulsion layer and at least one layer containing a hydrophilic colloid and from 0.1 to 15 g/m$^2$ of a cross-linked polymer represented by formula (I)

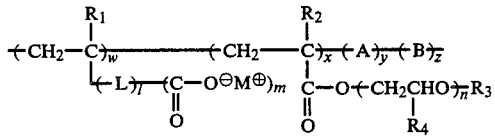

(I)

wherein $R_1$ and $R_2$ each represents a hydrogen atom or an unsubstituted or substituted alkyl group; $R_3$ represents a hydrogen atom, an unsubstituted or substituted alkyl group, cycloalkyl group, aryl group, or acyl group; $R_4$ represents a hydrogen atom or an unsubstituted or substituted alkyl group; or $R_3$ and $R_4$ together form a ring; L represents a divalent, trivalent or tetravalent connecting group; l represents 0 or 1; m represents an integer of 1 to 3; n represents an integer of 1 to 10; A represents a polymeric unit formed by copolymerizing an ethylenically unsaturated and copolymerized monomer; B represents a polymeric unit formed by copolymerizing a copolymerizable cross-linking monomer containing at least two copolymerizable and ethylenically unsaturated groups; M represents a cation; w represents 10 to 95 mol%; x represents 3 to 88 mol%; y represents 0 to 50 mol%, and z represents 2 to 30 mol%, said silver halide emulsion layer being the same as or different than said at least one layer.

2. A silver halide photographic element as in claim 1, wherein $R_1$ and $R_2$ represent a hydrogen atom, a methyl group, or a carboxymethyl group.

3. A silver halide photographic element as in claim 1, wherein $R_3$ represents an alkyl group having from 1 to 7 carbon atoms.

4. A silver halide photographic element as in claim 1, wherein $R_4$ represents a hydrogen or a methyl group.

5. A silver halide photographic element as in claim 1, wherein L is present and represents an alkylene group, an arylene group,

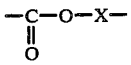

(wherein X represents an alkylene group having from 1 to 6 carbon atoms, or an arylene group),

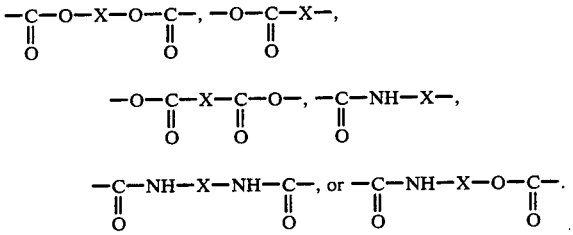

6. A silver halide photographic element as in claim 1, wherein w represents 30 to 80 mol%, x represents 10 to 60 mol%, y represents 0 to 30 mol%, and z represents 5 to 20 mol%.

7. A silver halide photographic element as in claim 1, wherein A represents a polymeric unit derived from ethylene, propylene, 1-butene, isobutene, styrene, α-methylstyrene, vinyltoluene, vinyl acetate, allyl acetate, methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, acrylonitrile, butadiene, or isoprene.

8. A silver halide photographic element as in claim 1, wherein B represents a polymeric unit derived from divinylbenzene, trivinylcyclohexane, ethylene glycol dimethacrylate, diethylene glycol dimethacrylate, triethylene glycol dimethacrylate, ethylene glycol diacrylate, diethylene glycol diacrylate, trimethylolpropane trimethacrylate, pentaerythritol tetramethacrylate, or pentaerythritol tetraacrylate.

9. A silver halide photographic element as in claim 1, wherein the cross-linked polymer represented by formula (I) is used in an amount of from 0.1 to 15 g/m$^2$.

10. A silver halide photographic element as in claim 1, wherein the cross-linked polymer represented by formula (I) is used in an amount of from 0.3 to 10 g/m$^2$.

11. A silver halide photographic element as in claim 1, wherein the cross-linked polymer represented by formula (I) is used in an amount of from 10 to 200 wt%, based on the total weight of hydrophilic colloid.

12. A silver halide photographic element as in claim 1, wherein the cross-linked polymer represents by formula (I) is used in an amount of from 30 to 150 wt%, based on the total weight of hydrophilic colloid.

13. A silver halide photographic element as in claim 1, wherein a silver halide emulsion layer contains the cross-linked polymer represented by formula (I).

14. A silver halide photographic element as in claim 1, containing an uppermost layer which contains the cross-linked polymer represented by formula (I).

15. A silver halide photographic element as in claim 1, containing an uppermost layer which contains a fluorine-containing surface active agent.

16. A silver halide photographic element as in claim 1, wherein said element is a black-and-white silver halide photographic light-sensitive element containing said cross-linked polymer represented by formula (I) in a silver halide emulsion layer.

* * * * *